United States Patent [19]

Inui et al.

[11] 4,157,944

[45] Jun. 12, 1979

[54] METHOD FOR PRETREATMENT IN THE PRODUCTION OF TIN-FREE STEEL

[75] Inventors: Tsuneo Inui, Tokuyama; Hitoshi Kuroda, Kudamatsu; Kenji Hizuka, Kudamatsu; Hideaki Hamano, Kudamatsu, all of Japan

[73] Assignee: Migita Patent Office, Tokyo, Japan

[21] Appl. No.: 917,893

[22] Filed: Jun. 22, 1978

[30] Foreign Application Priority Data

Oct. 31, 1977 [JP] Japan ..... 52-129752

[51] Int. Cl.[2] ..... C25D 5/12; C25D 5/36

[52] U.S. Cl. ..... 204/41; 204/29

[58] Field of Search ..... 204/35 N, 41, 29

[56] References Cited

U.S. PATENT DOCUMENTS

| | | | |
|---|---|---|---|
| 3,904,491 | 9/1975 | Smith | 204/41 |
| 3,928,157 | 12/1975 | Suematsu et al. | 204/41 |

FOREIGN PATENT DOCUMENTS

| | | | |
|---|---|---|---|
| 39-29949 | 4/1964 | Japan | 204/56 R |
| 50-14982 | 6/1975 | Japan | 204/56 R |

*Primary Examiner*—Howard S. Williams

*Attorney, Agent, or Firm*—Wenderoth, Lind & Ponack

[57] ABSTRACT

A method for the pretreatment of tin-free steel which comprises a cathodic treatment after an anodic treatment of a degreased steel sheet in an acid chromate electrolyte, said steel sheet consisting of an upper layer of hydrated chromium oxide and a lower layer of metallic chromium. This pretreated tin-free steel has excellent lacquer adhesion after aging in hot water and under retort conditions.

3 Claims, 1 Drawing Figure

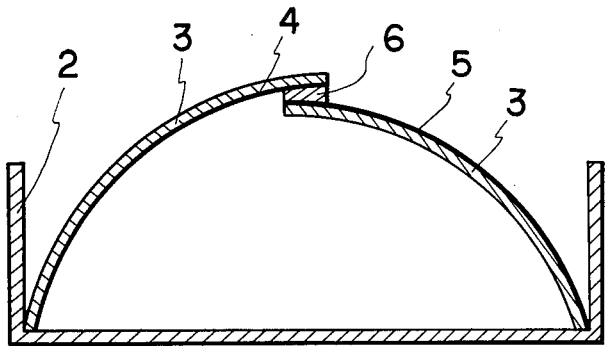
2
3
4
6
5
3

METHOD FOR PRETREATMENT IN THE PRODUCTION OF TIN-FREE STEEL

BACKGROUND OF THE INVENTION

The present invention relates to a pretreatment method in a manufacturing process of a tin-free steel (TFS) having an upper layer (layer farthest from the steel base) consisting of hydrated chromium oxide and a lower layer (layer closest to the steel base) consisting of metallic chromium.

DESCRIPTION OF THE PRIOR ART

Recently, lacquered TFS has largely been used for manufacturing carbonated beverage cans and beer cans, instead of electrotinplates, since it exhibits excellent lacquer adhesion.

The ordinary metal can consists of the two can ends and a can body. In the case of lacquered TFS, the seaming of the can body is mainly carried out with nylon adhesive by using the Toyo Seam and Mira Seam methods.

In these cases, the nylon adhesive is inserted not between the plain TFS surfaces, but between the lacquered TFS surfaces. An epoxy-phenolic type of lacquer is generally applied to the TFS.

Therefore, the bonding strength of the adhered part of the lacquered TFS can body is the sum of the bonding strength between the surface of the TFS and the lacquer film and the bonding strength between the lacquer film and the nylon adhesive. The nylon adhered part of the lacquered TFS can body not only has an acceptable bonding strength in the normal state, but also has a bonding strength which can satisfactorily withstand internal pressure caused by the contents, such as beer and carbonated beverages.

However, when a TFS can body seamed by nylon adhesive after lacquering is used to contain, e.g. fruit juices (which are immediately packed after pasteurization at temperatures of 90°-100° C.), or coffee, meat and fish (which are pasteurized by hot steam at a temperature above 100° C. in a retort after being packed in the packed in the can at 100° C.), the lacquer film may be peeled off from the TFS surface. Thus, a drop in the degree of vacuum in the can may occur from the adhered part of the can body, because the lacquer adhesion of the usual TFS becomes poor after aging in hot water and under retort conditions.

Therefore, it is not possible for a usual TFS can seamed with nylon adhesive after lacquering to be used for pasteurizing contents packed at high temperatures, as described above.

It is assumed that the deterioration of the lacquer adhesion of usual TFS, after aging in hot water and under the retort conditions depends on the properties of hydrated chromium oxide. In the manufacturing process of commercial TFS, a steel sheet is degreased by the immersion or electrolytic treatment in an alkaline solution containing sodium hydroxide or sodium phosphate and then rinsed with water. The degreased steel sheet is pickled by the immersion or electrolytic treatment in a dilute acid solution containing sulfuric acid or hydrochloric acid.

After rinsing with water, the steel sheet is subjected to an electrolytic chromic acid treatment.

SUMMARY OF THE INVENTION

It is an object of the present invention to provide TFS having an excellent lacquer adhesion after aging in hot water and under retort conditions by an improvement in the pretreatment of the TFS, during the manufacturing of commercial TFS.

In the present invention, the steel sheet is subjected to a cathodic treatment after an anodic treatment in an acid electrolyte containing at least one chromate selected from the group consisting of chromic trioxide, a chromate and a dichromate of an alkaline metal, ammonium chromate and ammonium dichromate after degreasing, instead of pickling by sulfuric acid or hydrochloric acid. The steel sheet is then subjected to the usual electrolytic chromic acid treatment.

The characteristics in the pretreatment of the present invention are summarized in the following three points:

(1) The steel sheet is not pickled in a solution such as sulfuric acid used for the pretreatment in the commercial TFS process.

(2) The steel sheet is treated in an acid chromate solution instead of pickling by an acid solution, such as sulfuric acid.

(3) The steel sheet is immediately cathodically treated after anodic treatment in an acid chromate electrolyte.

It is assumed that the surface of the steel sheet is activated with the removal of stains and impurities from the surface of the steel sheet by the anodic treatment. Then, a uniform and thin hydrated chromium oxide film, without the incorporation of an addition agent such as sulfuric acid or fluoride added to the electrolyte for chromium plating or electrolytic chromic acid treatment, is formed on the surface of the steel sheet by the cathodic treatment in the pretreatment of the present invention.

It is also considered that the hydrated chromium oxide film formed by the pretreatment of the present invention has excellent water resistance at high temperature and excellent acid and alkali resistance. Such film does not dissolve very easily into the electrolyte used for chromium plating or the electrolytic chromic acid treatment. Thus, it remains on the steel sheet and finally forms a top layer of TFS in the subsequent process for forming a metallic chromium layer and a hydrated chromium oxide layer on the surface thereof.

Therefore, it can be considered that TFS having excellent lacquer adhesion after aging in hot water and under retort conditions is provided by the pretreatment of the present invention.

It may seem contradictory that the hydrated chromium oxide film, which is formed by the pretreatment of the present invention forms a top layer of TFS. However, it can be assumed that the idea of the present invention is reasonable from a consideration that the hydrated chromium oxide, formed by the pretreatment of the present invention, dissolves only with great difficulty in a chromic acid solution with an addition agent, such as sulfuric acid, and from a consideration of the experimental results, using a radioactive isotope $^{51}Cr$ which has been previously reported by one of the present inventors (The Journal of the Metal Finishing Society of Japan, Vol. 23, No. 5, pp. 276-281, 1972).

In the present invention, the following methods have also been considered as possible electrolytic treatment methods:

(1) An anodic treatment alone, (2) A cathodic treatment alone, and (3) An anodic treatment after a cathodic treatment.

However, in the case of method (1), hydrated chromium oxide is not formed, whereas in the case of methods (2) and (3), the current efficiency for the formation of hydrated chromium oxide is so low that substantial quantities of electricity are necessary to form satisfactory hydrated chromium oxide.

Accordingly, these methods for electrolytic treatment are not suitable as the pretreatment for high speed production of TFS and cannot improve the lacquer adhesion of TFS after aging in hot water and under retort conditions.

BRIEF DESCRIPTION OF THE DRAWING

The FIGURE shows a brief cross-section which represents the testing method of the lacquer adhesion of a TFS specimen under retort conditions.

After one piece of TFS 3 having a thick lacquer film of epoxy-phenolic type 4, and another piece of TFS 3 having a thin lacquer film of epoxy-phenolic type 5 are adhered with nylon adhesive 6 on the edges, the resultant adhered specimen is fixed in the channel 2 in a bended state as shown in the FIGURE.

DETAILED DESCRIPTION OF THE INVENTION

In general, two types of manufacturing processes are well known for the production of commercial TFS. Namely, one is a one-step process in which metallic chromium and hydrated chromium oxide are simultaneously formed by using one electrolyte. The other is a two-step process in which metallic chromium is formed at first by using a chromium plating solution and then hydrated chromium oxide is formed on the metallic chromium layer by using other electrolytes.

The pretreatment step of the present invention is applicable to both the one-step and two-step processes and can improve the lacquer adhesion of TFS after aging in hot water and under retort conditions.

It is possible to apply the pretreatment of the present invention to a commercial TFS line without large scale reconstruction.

After degreasing by an alkaline solution used for the usual TFS process, the steel sheet is subjected to the pretreatment of the present invention. Thereafter, the pretreated steel sheet is subjected to an electrolytic chromic acid treatment by using the well known one- or two-step process, and then rinsed and dried.

It is immaterial whether or not rinsing if carried out after the pretreatment of the present invention since it does not affect the results.

The optimum range for the concentration of the acid chromate solution which is used for the pretreatment of the present invention is from 5 g/l to 50 g/l as hexavalent chromium ion.

If the concentration of hexavalent chromium ion is below 5 g/l, waste of electric power results because of the higher electric resistance of the solution used for the present invention.

The concentration of hexavalent chromium ion is limited to 50 g/l from the resources saving point of view, although the effect of the present invention is not decreased in a concentration above 50 g/l.

It is an essential condition that the solution used for the pretreatment of the present invention should be acidified. In the case of an alkaline solution, the efficiency for the formation of hydrated chromium oxide by the pretreatment of the present invention is so low that it takes a long time for the formation of a satisfactory hydrated chromium oxide.

The pretreatment by an alkaline solution is thus not suitable for the high speed production of TFS. Therefore, the solution containing only a chromate of an alkali metal or ammonium is not used for the pretreatment of the present invention. In the above case, it should be acidified by the addition of chromium trioxide.

It is also possible to add a hydroxide of an alkali metal or ammonium to chromic trioxide solution within an acid range.

It is not necessary that the temperature of the solution used for the pretreatment of the present invention be strictly controlled if it is below 60° C. If the temperature of the solution is above 60° C., the evaporation of water is increased and the efficiency for the formation of hydrated chromium oxide is unacceptably lowered.

The conditions of the electrolytic treatment are most important in the pretreatment of the present invention. The amount of hydrated chromium oxide which is formed by the pretreatment of the present invention is desirably in the range of from 3 mg/m$^2$ to 20 mg/m$^2$ as chromium. In order to form the above suitable amount of hydrated chromium oxide, 0.25–20 coulombs/dm$^2$ of electricity is necessary in each of the anodic and cathodic treatments.

If the amount of hydrated chromium oxide in the pretreatment of the present invention is below 3 mg/m$^2$ as chromium, the lacquer adhesion after aging in hot water and under retort conditions is not improved. When using chromium in amounts above 20 mg/m$^2$, some stain may appear on the surface of the steel sheet in the electrolytic chromic acid treatment carried out after the pretreatment of the present invention and the lacquer adhesion in the formed part may become poor.

In the anodic treatment, which is carried out first in the pretreatment of the present invention, at least 0.25 coulombs/dm$^2$ of electricity is necessary, because it is considered that the surface of the steel sheet is activated although hydrated chromium oxide is not formed. The quantity of electricity in the anodic treatment is limited to 20 coulombs/cm$^2$ to conserve resources in the high speed production of TFS. However, the effect of the present invention is not decreased by use of more than 20 coulombs/dm$^2$ of electricity for the anodic treatment.

The quantity of electricity in the cathodic treatment, carried out after the anodic treatment in the present invention, is closely connected with the amount of hydrated chromium oxide. If the quantity of electricity for the cathodic treatment is below 0.25 coulombs/dm$^2$, hydrated chromium oxide containing above 3 mg/m$^2$ as chromium is not formed, so it is impossible to obtain the effects of the present invention. Since hydrated chromium oxide above 20 mg/m$^2$ as chromium is formed on the surface of the steel sheet by use of a quantity of electricity above 20 coulomb/dm$^2$ in the cathodic treatment, it is not desirable as described above.

From an industrial point of view, the application of the following methods has been considered in conjunction with applicants' pretreatment, and it has been discovered that the effect of the present invention does not change by use of these methods. The first is a method in which the cycle consisting of the cathodic treatment after the anodic treatment is repeated several times. The second is a method in which the cathodic treatment is carried out in a second tank without water rinsing, after the anodic treatment has been carried out in the first tank.

It is reasonable that the range of each electrolytic time is 0.1–5 seconds, and the range of each current density is 1.0–50 A/dm$^2$ in the anodic and cathodic treatments of the present invention, because the pretreatment of the present invention must be suitable for the high speed production of TFS.

It is also considered that the effect of the present invention is obtained by the pretreatment which is carried out after the usual alkali degreasing and acid pickling. However, in the above case, the effect of the present invention is remarkably reduced because the very small amount of sulfate ion, which remains on the surface of the steel sheet in spite of water rinsing, has bad effects on the properties of the hydrated chromium oxide formed by the pretreatment.

The present invention is illustrated by the following examples.

EXAMPLE 1

A cold-rolled steel sheet having a thickness of 0.23 mm was electrolytically degreased in a solution of 70 g/l sodium hydroxide. After rinsing with water, the steel sheet was pretreated under the following conditions.

| Conditions of Pretreatment | |
|---|---|
| Composition of electrolyte | |
| Chromic trioxide | 50 g/l |
| pH of electrolyte | 0.4 |
| Temperature of electrolyte | 30° C. |
| Electrolytic method | |
| Cathodic treatment after anodic treatment | |
| Anodic and cathodic current density | Each 1 A/dm$^2$ |
| Anodic and cathodic treating time | Each 1 sec. |

After rinsing with water, the pretreated steel sheet was subjected to electrolytic chromic acid treatment under the following conditions and was then rinsed with water and dried.

| Conditions of Electrolytic Chromic Acid Treatment | |
|---|---|
| Composition of electrolyte | |
| Chromic trioxide | 100 g/l |
| Sulfuric acid | 0.5 g/l |
| Hydrofluoboric acid | 1.0 g/l |
| Temperature of electrolyte | 55° C. |
| Cathodic current density | 40 A/dm$^2$ |
| Treating time | 2 sec. |

EXAMPLE 2

The same kind of steel sheet degreased as in Example 1 was pretreated under the following conditions after rinsing with water.

| Conditions of Pretreatment | |
|---|---|
| Composition of electrolyte | |
| Chromic trioxide | 100 g/l |
| pH of electrolyte | 0.2 |
| Temperature of electrolyte | 40° C. |
| Electrolytic method | |
| Cathodic treatment after anodic treatment | |
| Anodic and cathodic current density | Each 5 A/dm$^2$ |

-continued

| Conditions of Pretreatment | |
|---|---|
| Anodic and cathodic treating time | Each 0.5 sec. |

Without water rinsing, the pretreated steel sheet was plated with metallic chromium by using the usual Sargent bath under 20 A/dm$^2$ of cathodic current density for 5 sec. at 50° C. of electrolyte temperature. After rinsing with water, the chromium plated steel sheet was subjected to electrolytic chromic acid treatment under the following conditions and was then rinsed with water and dried.

| Conditions of Electrolytic Chromic Acid Treatment | |
|---|---|
| Composition of electrolyte | |
| Chromic trioxide | 50 g/l |
| Sulfuric acid | 0.2 g/l |
| Hydrofluoboric acid | 0.6 g/l |
| Temperature of electrolyte | 45° C. |
| Cathodic current density | 10 A/dm$^2$ |
| Treating time | 0.5 sec. |

EXAMPLE 3

The same kind of steel sheet degreased as in Example 1 was pretreated under the following conditions after rinsing with water.

| Conditions of Pretreatment | |
|---|---|
| Composition of electrolyte | |
| Sodium dichromate | 40 g/l |
| pH of electrolyte | 4.1 |
| Temperature of method | |
| Cathodic treatment after anodic treatment | |
| Anodic and cathodic current density | Each 10 A/dm$^2$ |
| Anodic and cathodic treating time | Each 2 sec. |

After rinsing with water, the pretreated steel sheet was subjected to an electrolytic chromic acid treatment under the following conditions and was then rinsed with water and dried.

| Conditions of Electrolytic Chromic Acid Treatment | |
|---|---|
| Composition of electrolyte | |
| Chromic trioxide | 100 g/l |
| Sulfuric acid | 0.2 g/l |
| Hydrosilicofluoric acid | 0.8 g/l |
| Temperature of electrolyte | 60° C. |
| Cathodic current density | 50 A/dm$^2$ |
| Treating time | 1.5 sec. |

EXAMPLE 4

The same kind of steel sheet degreased as in Example 1 was pretreated under the following conditions after rinsing with water.

| Conditions of Pretreatment | |
|---|---|
| Composition of electrolyte | |
| Chromic trioxide | 30 g/l |
| pH of electrolyte | 0.7 |
| Temperature of electrolyte | 40° C. |
| Electrolytic method | |
| Cathodic treatment after anodic treatment | |
| Anodic and cathodic current density | Each 2 A/dm$^2$ |

-continued

| Conditions of Pretreatment | |
|---|---|
| Anodic and cathodic treating time | Each 0.5 sec. |

Without water rinsing, the pretreated steel sheet was plated with metallic chromium by using an electrolyte consisting of 100 g/l of chromic trioxide and 5 g/l of sodium fluoride under 40 A/dm$^2$ of cathodic current density for 2 sec. at 55° C. of electrolyte temperature. After rinsing with water, the chromium plated steel sheet was subjected to electrolytic chromic acid treatment under the following conditions and was then rinsed with water and dried.

| Conditions of Electrolytic Chromic Acid Treatment | |
|---|---|
| Composition of electrolyte | |
| Chromic trioxide | 30 g/l |
| Sulfuric acid | 0.08 g/l |
| Sodium fluoride | 0.4 g/l |
| Temperature of electrolyte | 45° C. |
| Cathodic current density | 10 A/dm$^2$ |
| Treating time | 1 sec. |

As comparative examples, the same kind of steel sheet degreased as in Example 1 was pickled by immersion into a solution of 100 g/l sulfuric acid for 2 sec. at room temperature after rinsing with water, instead of the pretreatment of the present invention.

After rinsing with water, Comparative Examples 1, 2, 3 and 4 were subjected to electrolytic chromic acid treatment or electrolytic chromic acid treatment after chromium plating under the same conditions as in Examples 1, 2, 3 and 4, respectively, and were then rinsed with water and dried.

The amount of metallic chromium and hydrated chromium oxide as chromium in TFS film which was prepared in Examples 1, 2, 3 and 4 and in Comparative Examples 1, 2, 3 and 4, was measured and the characteristics of each resultant TFS were evaluated by the following test methods, the results of which are shown in the Table 1.

(1) Lacquer adhesion in the part adhered with nylon adhesive.

Two pieces of the treated sample were prepared. One piece of the treated sample was baked at 210° C. for 12 minutes after coating with 60 mg/dm$^2$ of an epoxy-phenolic type lacquer and the other piece was baked under the same conditions as described above after coating with 25 mg/dm$^2$ of the same lacquer.

The two differently coated sample pieces were each cut to a size of 5 mm×100 mm and bonded together using a nylon adhesive having a thickness of 100 μm at 200° C. for 30 seconds under 3 kg/cm$^2$ of pressure by a Hot Press after pretreating at 200° C. for 120 seconds.

The bonding strength of the assembly which is shown as kg/5 mm was measured by a conventional tensile testing machine.

(2) Lacquer adhesion after aging in hot water

The assembly prepared by the method described in (1) above, was peeled by a conventional tensile testing machine after the assembly was immersed in a 0.4% citric acid solution at 90° C. for 3 days. The bonding strength of the assembly was shown as kg/5 mm.

(3) Lacquer adhesion under retort conditions

Two pieces of the differently coated samples prepared by the method described in (1) above, were each cut to a size of 70 mm width and 60 mm length, respectively, and were bonded in such a way as to overlap each other by 8 mm in a longitudinal direction under the same conditions as described in (1).

Ten assembled samples were prepared as described above.

Each assembled sample was curled to a radius of 100 mm. as for a can body, and then fixed in a channel of 70 mm width.

After that, the ten fixed samples were set in a retort in which hot steam, heated to 125°–130° C. under a pressure of 1.6–1.7 kg/cm$^2$, was blown for 150 minutes or for 300 minutes. The lacquer adhesion under the retort conditions was evaluated by the number of the samples which had peeled to the total ten assembled samples.

As shown in Table 1, it is evident that there are very clear differences between the Examples of the present invention and the Comparative Examples in the lacquer adhesions after aging in hot water and under the retort conditions, although there is no difference between the Examples of the present invention and the comparative examples in the lacquer adhesion in a normal state.

It is recognized from these Examples that the pretreatment of the present invention has the remarkable effect of improving the lacquer adhesion after aging in hot water and under the retort conditions.

TABLE 1

| | CHARACTERISTICS OF TREATED STEEL SHEETS | | | | | | | |
|---|---|---|---|---|---|---|---|---|
| | Example 1 | Example 2 | Example 3 | Example 4 | Comparative Example 1 | 2 | 3 | 4 |
| Amount of metalic Cr in g/m$^2$ | 0.092 | 0.114 | 0.089 | 0.091 | 0.090 | 0.123 | 0.87 | 0.090 |
| Amount of hydrated Cr oxide (as Cr) in g/m$^2$ | 0.017 | 0.019 | 0.022 | 0.018 | 0.013 | 0.014 | 0.010 | 0.014 |
| Lacquer adhesion in normal state (kg/5 mm) | 6.3 | 6.5 | 6.8 | 6.7 | 6.2 | 6.1 | 6.8 | 6.6 |
| Lacquer adhesion after aging in hot water (kg/5mm) | 2.1 | 2.9 | 2.4 | 3.5 | 0.8 | 1.7 | 0.4 | 1.8 |
| Lacquer adhesion under retort conditions (A/B)* 150 min. | 1/10 | 0/10 | 0/10 | 0/10 | 8/10 | 4/10 | 9/10 | 3/10 |
| Lacquer adhesion under retort conditions (A/B)* 300 min. | 6/10 | 3/10 | 4/10 | 0/10 | 10/10 | 10/10 | 10/10 | 8/10 |

*A shows the number of the peeled assembly.
B shows the total number of the assembly.

What is claimed is:

1. A method for the pretreatment of a tin-free steel consisting of an upper layer of hydrated chromium oxide and a lower layer of metallic chromium, which comprises subjecting a steel sheet, before the formation of the upper layer of chromium oxide and lower layer of metallic chromium, to a pretreatment consisting of an anodic treatment followed by a cathodic treatment in an acid electrolyte containing at least one chromate selected from the group consisting of chromic trioxide, a chromate and a dichromate of an alkaline metal, ammonium chromate and ammonium dichromate, after degreasing said steel sheet.

2. A method according to claim 1, wherein the cathodic and anodic treatments are carried out at a temperature below 60° C. and a current density of 1.0–50 $A/dm^2$ for 0.1–5 seconds in electrolyte acid electrolytic containing 5–50 g/l of hexavalent chromium ion.

3. A method according to claim 1, wherein the cathodic and anodic treatments are carried out at 0.25–20 $coulombs/dm^2$ in an acid electrolyte containing 5–50 g/l of hexavalent chromium ion, for the formation of hydrated chromium oxide in the amount of 3–20 $mg/m^2$ as chromium.

* * * * *

UNITED STATES PATENT AND TRADEMARK OFFICE

CERTIFICATE OF CORRECTION

PATENT NO. : 4,157,944

DATED : June 12, 1979

INVENTOR(S) : Tsuneo Inui, Hitoshi Kuroda, Kenji Hizuka, Hideaki Hamano

It is certified that error appears in the above-identified patent and that said Letters Patent are hereby corrected as shown below:

On the title page, next to "[73] Assignee", change "Migita Patent Office, Tokyo, Japan" to -- Toyo Kohan Co., Ltd., Tokyo, Japan --.

Signed and Sealed this

*Thirtieth* Day of *October 1979*

[SEAL]

*Attest:*

RUTH C. MASON
*Attesting Officer*

LUTRELLE F. PARKER
*Acting Commissioner of Patents and Trademarks*